United States Patent [19]

Hauk

[11] Patent Number: 4,843,924

[45] Date of Patent: Jul. 4, 1989

[54] COMPACT HIGH-TORQUE APPARATUS AND METHOD FOR ROTATING PIPE

[75] Inventor: Thomas D. Hauk, Los Alamitos, Calif.

[73] Assignee: Hawk Industries, Inc., Long Beach, Calif.

[21] Appl. No.: 95,526

[22] Filed: Sep. 10, 1987

[51] Int. Cl.[4] ..... B25B 17/00

[52] U.S. Cl. ..... 81/57.20; 81/57.17; 81/57.19; 81/57.33

[58] Field of Search ..... 81/57.17, 57.19, 57.20, 81/57.18, 57.33

[56] References Cited

U.S. PATENT DOCUMENTS

| | | | |
|---|---|---|---|
| 1,760,167 | 5/1930 | Palmer . | |
| 1,805,007 | 5/1931 | Pedley . | |
| 1,925,970 | 9/1933 | Pennington | 81/57 |
| 2,353,642 | 7/1944 | Buice | 81/57 |
| 2,460,671 | 2/1949 | Benedick | 214/1 |
| 2,523,159 | 9/1950 | Stone | 255/35 |
| 2,523,193 | 9/1950 | Carson | 255/35 |
| 2,746,329 | 5/1956 | Paget | 81/53 |
| 2,753,744 | 7/1956 | Therien | 81/57 |
| 2,760,392 | 8/1956 | Paget | 81/53 |
| 2,784,626 | 3/1957 | Paget | 81/53 |
| 2,862,690 | 12/1958 | Mason | 255/35 |
| 3,122,211 | 2/1964 | Wilson et al. | 173/164 |
| 3,308,691 | 3/1967 | Guier | 81/54 |
| 3,691,875 | 9/1972 | Geczy et al. | 81/57 |
| 3,892,140 | 7/1975 | Fox et al. | 74/224 |
| 3,906,820 | 9/1975 | Hauk | 81/57.17 |
| 4,099,429 | 7/1978 | Hauk | 81/57.17 |
| 4,471,674 | 9/1984 | Doss | 81/57.17 |
| 4,512,216 | 4/1985 | Callegari, Sr. et al. | 81/57.17 |
| 4,604,922 | 8/1986 | Soutsos | 81/57.17 |

*Primary Examiner*—Frederick R. Schmidt
*Assistant Examiner*—Lawrence Cruz
*Attorney, Agent, or Firm*—Richard L. Gausewitz

[57] ABSTRACT

Apparatus for rotating a tubular well element about its longitudinal axis. There are first and second elongate casing sections pivotally connected to each other at a pivot. First and second driven sprockets are mounted, respectively, on the casing sections at locations remote from the pivot. A drive sprocket, mounted on the first casing section, is driven by a motor-gear assembly. A continuous chain is mounted around the drive sprocket, and around the first and second driven sprockets, having an inverse internal portion adapted to receive and directly contact the tubular well element to be rotated. Cylinders are connected between the casing sections to pivot them toward and away from each other and thus alternately clamp the inverse internal portion around the wall element, and release such element from the inverse internal portion. One end of each cylinder is pivotally connected to the first casing section at a point between the pivot and the first driven sprocket. The other end of each cylinder is pivotally connected to the second casing section at a point between the pivot and the second driven sprocket.

27 Claims, 5 Drawing Sheets

COMPACT HIGH-TORQUE APPARATUS AND METHOD FOR ROTATING PIPE

BACKGROUND OF THE INVENTION

This invention relates primarily to the field of rotating one tubular member relative to another, about the common longitudinal axis of both such members, during the making or breaking of threaded connections between such members. The tubular members are normally pipe sections used relative to oil wells, water wells, etc., and are sometimes hereinafter called "well elements". It has been common in this field to use one tool, called a spinner, to effect relatively high-speed rotation of one pipe section relative to the other when there is but little resistance to such rotation, and then to employ another tool to tighten (torque) a joint being formed or to initially loosen (break out) a joint being disconnected. Although such two tools are sometimes on the same housing, they are conventionally separate tools and separately operated.

There is a major need in the oil well and water well industries, and others, to provide a single tool that is compact, practical, effective and economical, and that can be employed to do the spinning and torquing in one operation—without changing tools or changing from one part of a tool to another part thereof. It is, however, not meant to be implied that any such combination tool can achieve the very high torques required in some types of joints. Instead, it is the purpose to indicate that there are many types of joints, for example in pump service, water drilling, core drilling and exploration drilling, where a single tool incorporating the present invention can perform both spinning and torquing in one operation. Such spinning and torquing in one operation increases productivity, lowers operational costs, and is relatively safe and fast.

It is highly important that such a tool be relatively small and compact, as well as being much lighter than many spinning and torquing tools in the prior art. The tool must be adapted to effect the spinning and torquing functions when the pipe sections are either vertical or horizontal, and must have the ability to control torque in order to reduce the risk of damage to threaded connections.

It is of distinct importance that the tool be adapted to spin and torque pipes having substantially different outer diameters. For example, one embodiment of the present tool is adapted to be employed relative to pipe sections ranging from $2\frac{3}{8}$ inches in diameter to $5\frac{1}{2}$ inches in diameter. The changing from operation on a pipe of one diameter, to operation on a pipe of another diameter, must be effected relatively rapidly and easily and in a substantially foolproof manner.

The tool should be such that it will open wide so as to be able to swing easily on or off the threaded connection. It should also be such that there is no need to make any part excessively massive and heavy for the function that it performs. The tool must be such that the pipe sections are very firmly gripped without, however, causing the pipe sections to be cut, crushed or excessively marred.

SUMMARY OF THE INVENTION

The present apparatus and method supply the above-indicated needs and perform the above-indicated functions. In one embodiment, the tool is only about a yard long and, being small and light in comparison to priorart structures conventionally employed for performing spinning and torquing.

Instead of having the two jaws conventional in commercial pipe spinners, the preferred embodiment of the present tool has a clamshell construction, and the clamshell is opened and closed by powerful balanced-cylinder means disposed near the pipe section being operated upon. Such balanced-cylinder means are preferably hydraulic and create enormous force effecting clamping of drive rollers and a drive chain on the pipe.

The drive rollers and drive chain cooperate with each other to effect very firm clamping of the pipe, without crushing or cutting it, so that high torques are generated when the chain and rollers are driven by a hydraulic motor. As a specific example (which is given by way of example only, not limitation), the torque may range between about 762 foot pounds and about 4,030 foot pounds, depending upon pipe diameter and depending on whether the fluid pressure is 1,500 psi or up to 3,000 psi. It is to be understood that higher and lower pressures may be employed, with consequent lessening or increasing of the torque.

The drive rollers employed in the present tool are relatively wide (thick), so as not to bite into or cut the pipe despite the great pressures employed.

The hydraulic motor drives the drive sprocket and thus the chain, which, in turn, drives the driven sprockets and the rollers, there being no need for intermediate sprockets such as have been employed by the assignee of applicant in its prior tools. The drive sprocket for the chain is adjustable to be at different distances from the pipe, in a very simple, economical and foolproof manner. In the present commercial embodiment, there are three sets of bolt holes, the sets being at different distances from the driven sprockets. The locations of the bolt holes are such that at least some can be employed relative to a plurality of pipe diameters. Thus, in the present commercial embodiment, one set of bolt holes accommodates pipe sections the diameters of which range from $2\frac{3}{8}$ inches to 3 inches; another set of bolt holes accommodates pipe diameters ranging from $3\frac{1}{2}$ inches to 3 7/10 inches; and another set of bolt holes accommodates pipe sections ranging from $4\frac{1}{2}$ inches to $5\frac{1}{2}$ inches. All the operator needs to do is know the size of the pipe being operated upon, following which he shifts the motor unit so that the appropriate set of bolt holes registers with bolt holes on the motor housing.

In the present preferred construction, one side of the clamshell is a wide part of the casing. The other side of the clamshell is a narrow part of the casing. The pivot point for such one side and such other side is located far from the driven sprockets. Furthermore, such pivot point is offset substantially from a line extending through the axis of the drive sprocket and the axis of that driven sprocket which is on the wide part of a casing. Such offset permits the narrow part of the casing to be relatively light for a tool of this type, without being caused to bend or break when the very high closing pressures are applied.

The open position of the tool is such that the tool can easily swing on or off the connection being made or broken. Then, assuming that the tool has been swung onto a joint to be made, the balanced cylinders, which are located near such joint, effectively close the clamshell to create the extremely high gripping pressures necessary for achieving the desired torques. Such gripping pressures may be readily controlled, for example by regulating the pressure of the hydraulic fluid.

The present tool may, if desired, also be employed purely for spinning pipe, instead of spinning and torquing it.

DETAILED DESCRIPTION OF THE PREFERRED EMBODIMENT

Figure 2:
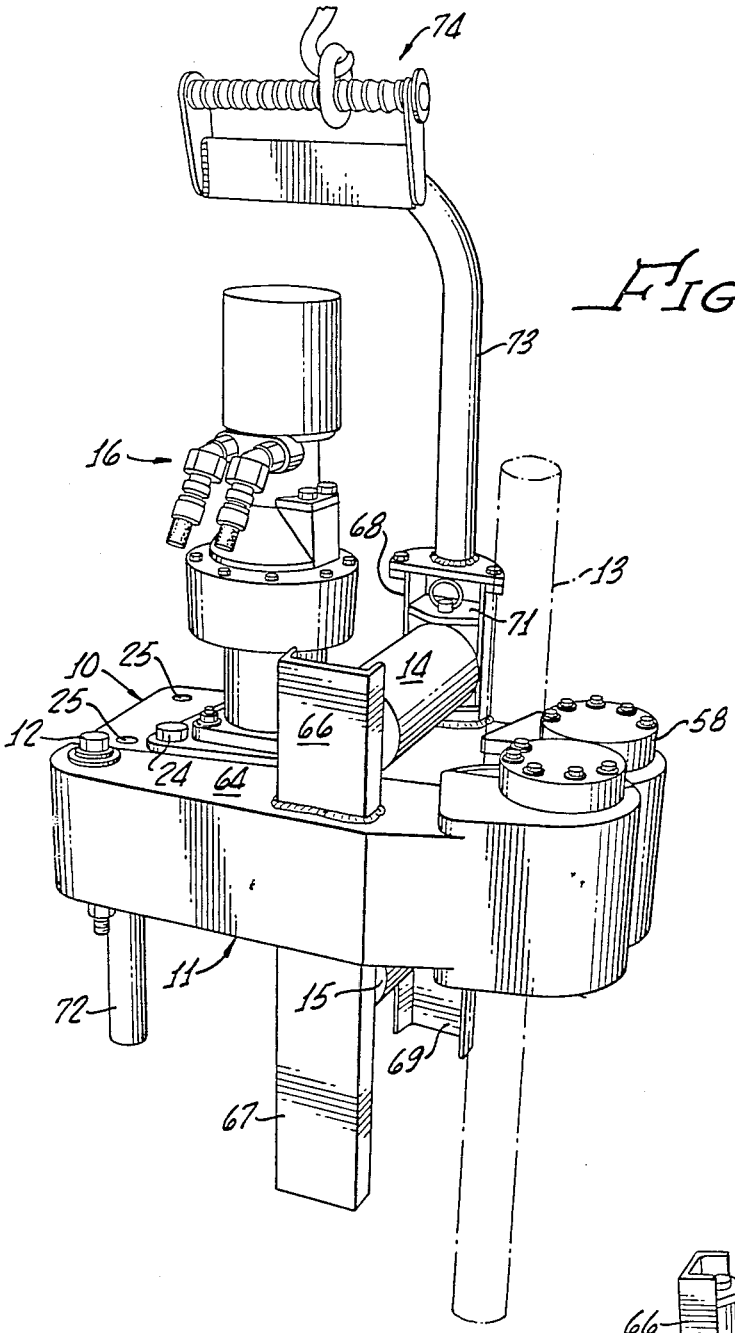
FIG. 2 is an isometric view, looking from the left in FIG. 1, and showing the tool in closed condition on a pipe.
Figure 1:
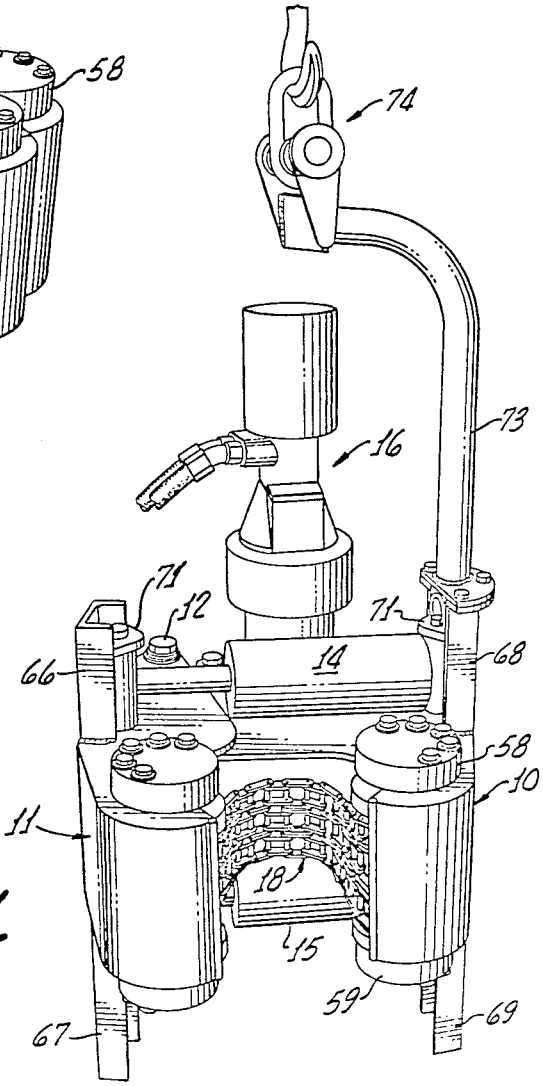
FIG. 1 is a perspective view showing the present tool in an open condition prior to swinging of the tool onto a pipe section.

Referring particularly to FIGS. 1 and 2, the present spinning and torquing apparatus comprises a clamshell casing having a wide section 10 and narrow section 11. Casing sections 10, 11 are pivotally connected to each other at a pivot bolt 12, such pivoting being about a vertical axis when the tool is operating on a vertically-arranged pipe, such as is shown in phantom at 13 in FIG. 2.

Cylinders 14, 15 are located between pivot bolt 12 and pipe 13, and are preferably disposed as close as practical to the pipe 13 for maximum mechanical advantage. Thus, each casing section 10, 11 is operated as a third class lever (the expression "third class" being herein employed to denote a lever in which the force-generating means is disposed between the fulcrum and the resistance).

Cylinders 14, 15 generate balanced forces, and very high forces, since cylinder 14 is disposed above casing sections 10, 11, while cylinder 15 is disposed therebeneath. The cylinders are correspondingly sized and constructed, are parallel to each other, and are spaced equal distances above and below the central horizontal plane of the casing or housing.

A hydraulic motor and gear assembly 16 is mounted on wide casing section 10 at a location remote from pipe 13, on the opposite side of cylinders 14, 15 from such pipe. The motor-gear assembly 16 connects to a drive sprocket 17 shown in FIGS. 4 and 5. Sprocket 17 drives a chain 18 that extends to two driven sprockets 19, 20 (FIG. 5), sprocket 19 being on wide section 10, while sprocket 20 is on narrow section 11.

The chain 18, upon being driven by drive sprocket 17 and its associated motor and gear assembly 16, drives the pipe 13 directly by engaging it as the chain moves. Furthermore, the chain 18 operates through sprockets 19, 20 to drive upper and lower sets of drive rollers 21, 22, best shown in FIG. 6, which rollers are in driving relationship to the pipe 13. The chain, rollers and other elements cooperate with each other to grip the pipe very firmly, and to rotate it with high torque, as described subsequently.

Figure 3:
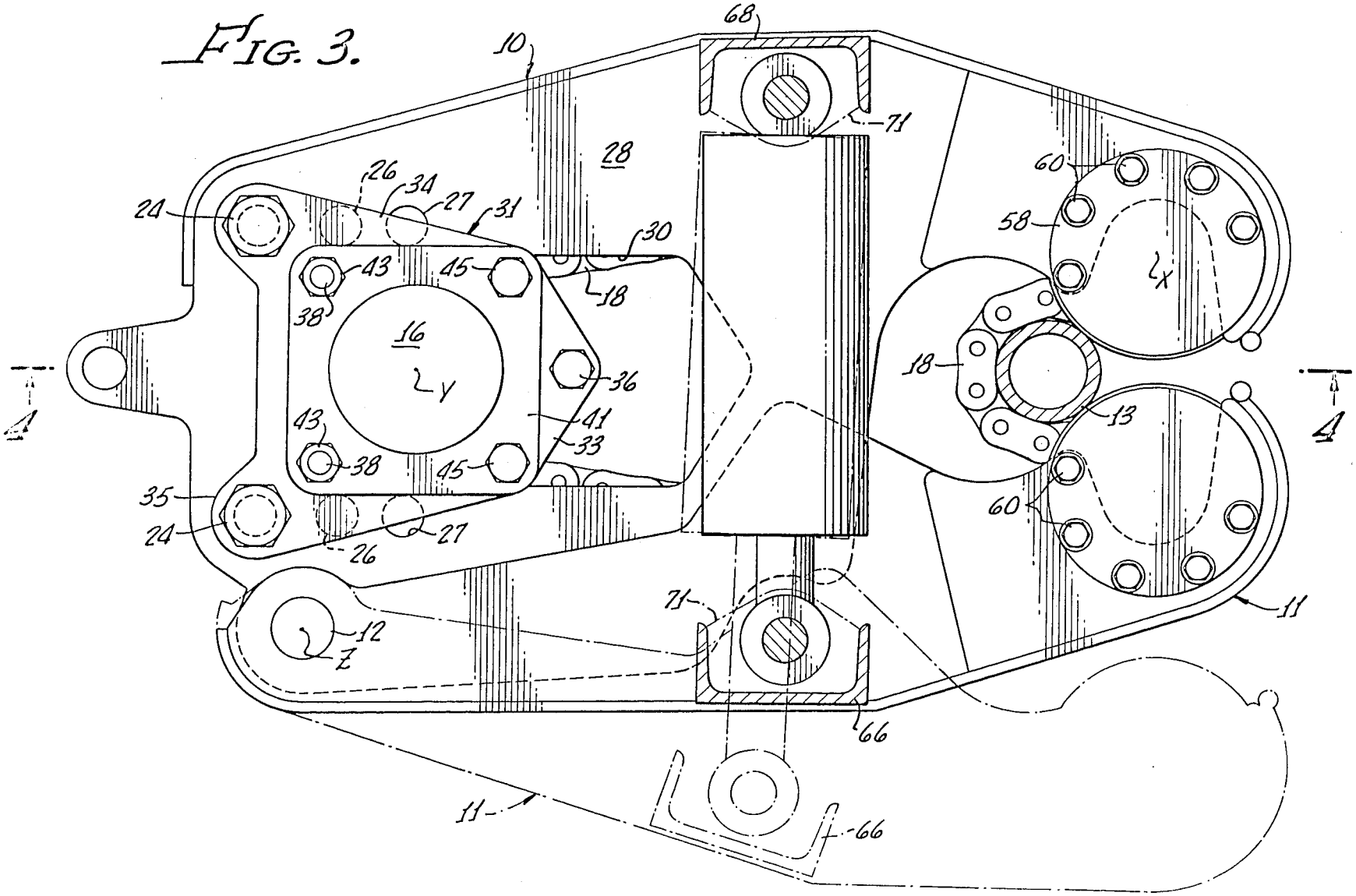
FIG. 3 is a view, primarily in top plan, the open condition of the tool being shown in phantom.
Figure 4:
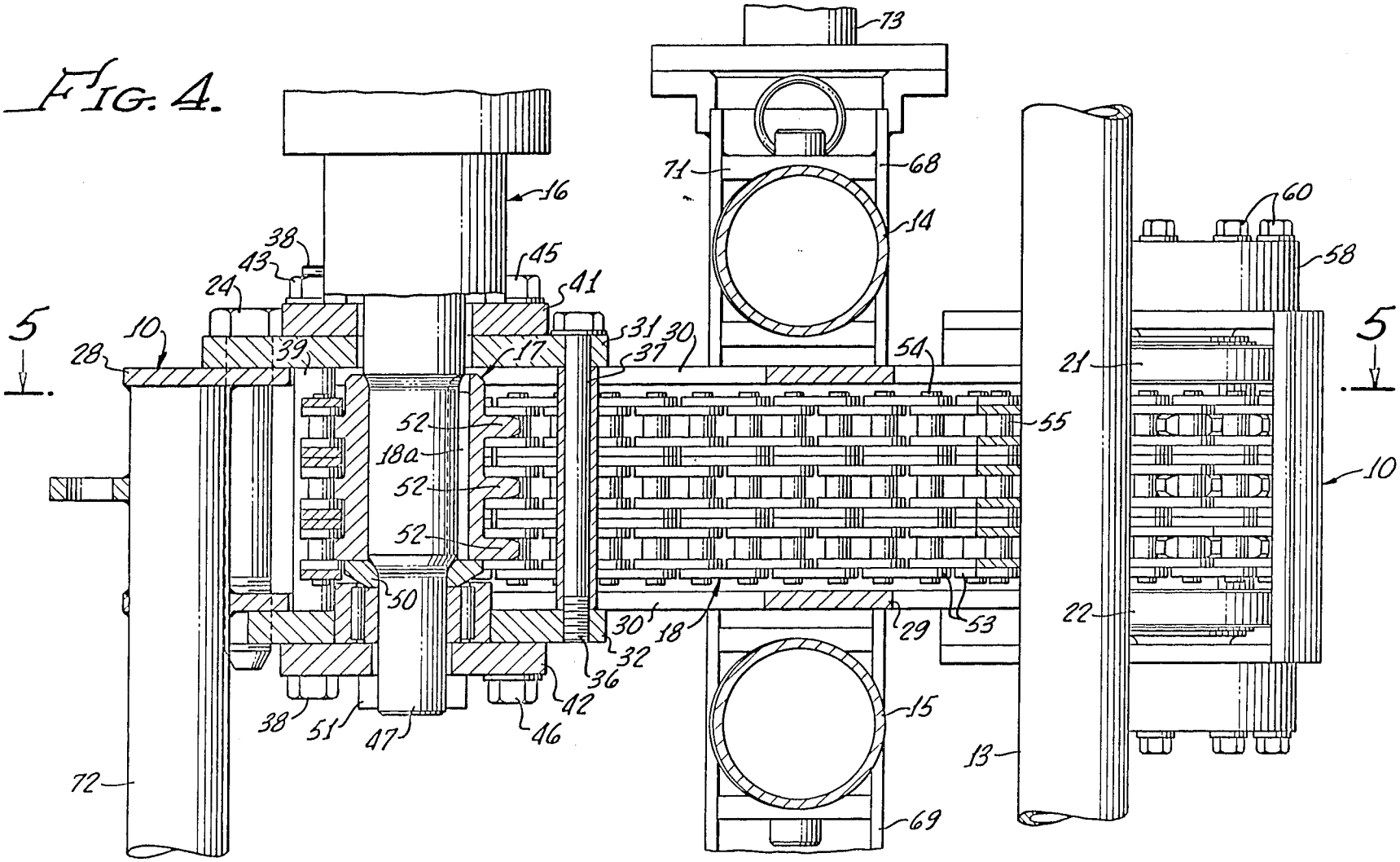
FIG. 4 is a vertical sectional view taken on line 4—4 of FIG. 3.

Means are provided on the present clamshell casing to adjust motor assembly 16 toward and away from the pipe 13, such means being bolts 24 and associated holes 25–27 indicated in FIGS. 2–4.

Most of the main parts of the present tool thus having been indicated, the tool will now be described in more detail.

The wide section 10 of the clamshell casing or housing has upper and lower walls 28 and 29, respectively, that are parallel to each other. Each such wall has a large opening 30 therein, the openings being generally rectangular (except that the forward ends are somewhat pointed, as shown in dashed lines in FIG. 3).

Upper and lower slide plates 31 and 32 are mounted on the outer surfaces of walls 28 and 29, respectively. Slide plates 31, 32 are identical to each other. Each is shaped (FIG. 3) with a pointed front end 33, with rearwardly swept side wings 34, and with tail protuberances 35.

Figure 5:
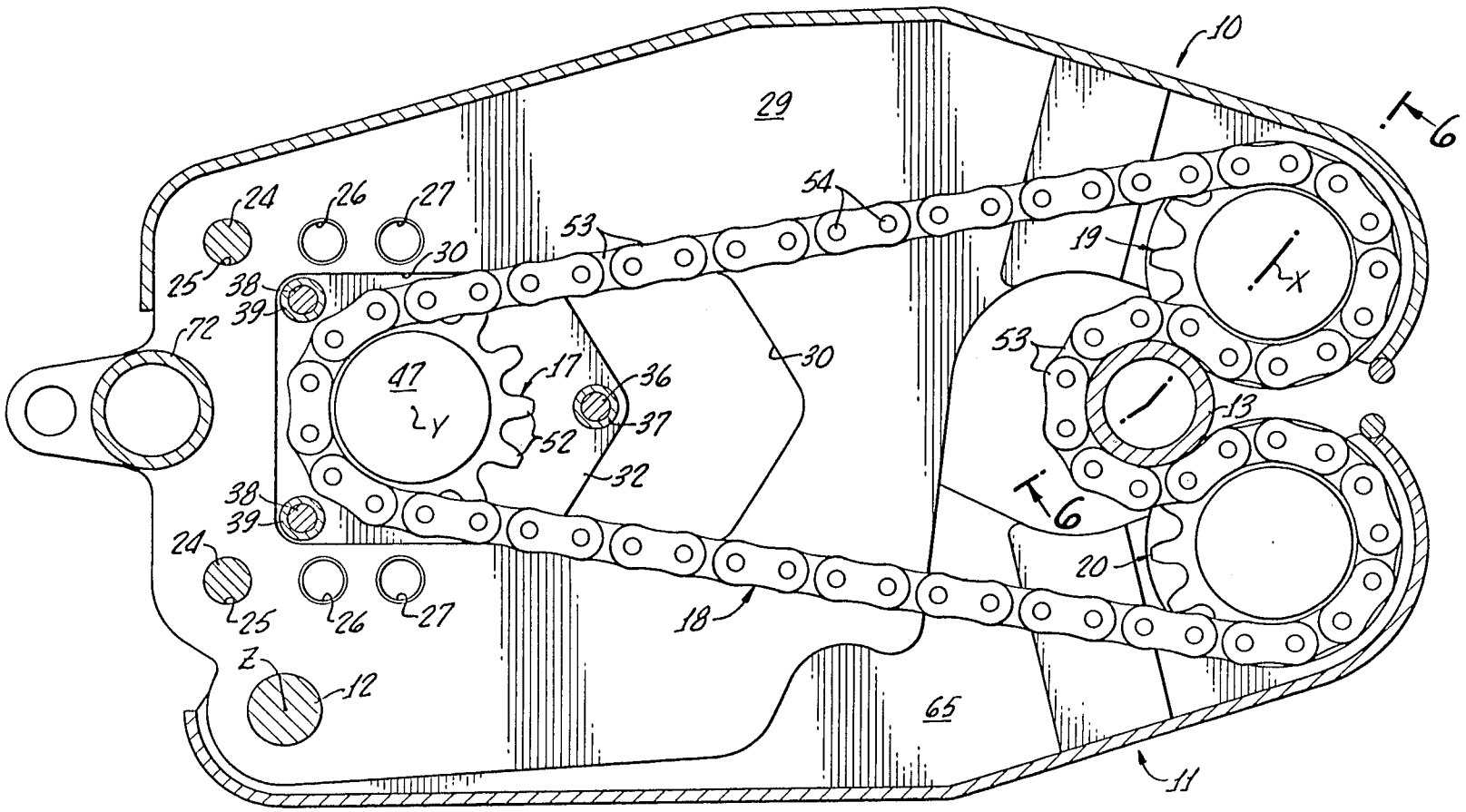
FIG. 5 is a horizontal sectional view taken on line 5—5 of FIG. 4.

A front bolt 36 extends through the front ends 33 of both plates 31, 32 to connect such front ends of the plates, but not in any binding or clamping relationship. Instead, as shown in FIGS. 4 and 5, a spacer tube 37 is provided around bolt 36 to prevent any clamping from occurring between the slide plates and the outer surfaces of walls 28, 29. It is to be noted that the front bolt 36 and its spacer 37 are at all times in the openings 30 in walls 28, 29, so that these walls do not interfere with forward and rearward movement of the slide plates for adjustment purposes.

In like manner, rear bolts 38 are extended through slide plates 31, 32 and openings 30, and spacer tubes 39 (FIGS. 4 and 5) are provided around such rear bolts to prevent the slide plates from being in tight engagement with casing walls 28, 29, but instead to permit free sliding therebetween. Rear bolts 38 also extend at the upper side of the housing through a flange plate 41 (FIG. 4) that is rigidly associated with the housing of motor and gear assembly 16. The rear bolts 38, at the bottom of the tool, extend through a bearing plate (FIG. 4) for the drive sprocket 17.

The front bolt 36 is threaded downwardly into lower slide plate 36. Conversely, the rear bolts 38 extend upwardly through bearing plate 42, lower slide plate 32, upper slide plate 31, and flange plate 41, the bolts 38 having nuts 43 at the upper ends thereof.

Short bolts 44 (FIG. 3) are extended through the forward corners of flange plate 41, being threaded into the upper slide plate 31 and cooperating with the bolts 38 in holding the motor and gear assembly 16 fixedly in position relative to the slide plates, etc. An additional pair of short bolts, numbered 46 (FIG. 4), extends upwardly through the forward corners of bearing plate 42, being threaded into the lowerslide plate 32 so as to cooperate with the bolts 38 in holding bearing plate 42 in fixed relationship to lower slide plate 32.

With the described construction, the slide plates and the motor assembly 16 can slide together toward and away from the pipe 13, with the slide plates 31, 32 sliding freely on the outer surfaces of walls 28, 29 (there being lubricant between the slide surfaces). This can occur any time the operator desires, so long as the above-indicated adjustment bolts 24, which will be further described below, are not in position.

It is pointed out that the casing walls that define opening 30 cooperate with the slide plates and the spacer tubes 37 and 39 to prevent the motor assembly 16 from tipping relative to the wide housing section 10. It is also pointed out that the side wings 34 (FIG. 3) and tail protuberances 35 of slide plates 31, 32 overlap and underlap the housing walls 28 and 29, respectively, so as to aid in preventing any such tipping of the motor assembly 16, and to provide firm support for such assembly and for the associated parts.

Very importantly, the described construction prevents any bolt or spacer from interfering with the chain, regardless of the position of the drive sprocket.

Referring to FIG. 4, motor assembly 16 has a large-diameter, strong shaft 47 that extends downwardly through plates 41, 31, 32 and 42, and has the above-indicated drive sprocket 17 fixedly mounted thereon by a key indicated at 18a. At its lower portion, shaft 47 extends through a roller bearing 49 that is mounted in lower slide plate 32 and thereabove, being sandwiched between bearing plate 42 and a collar 50 at the lower end of the sprocket 17. An additional collar, numbered 51, is provided at the extreme lower end of shaft 47.

Figure 6:
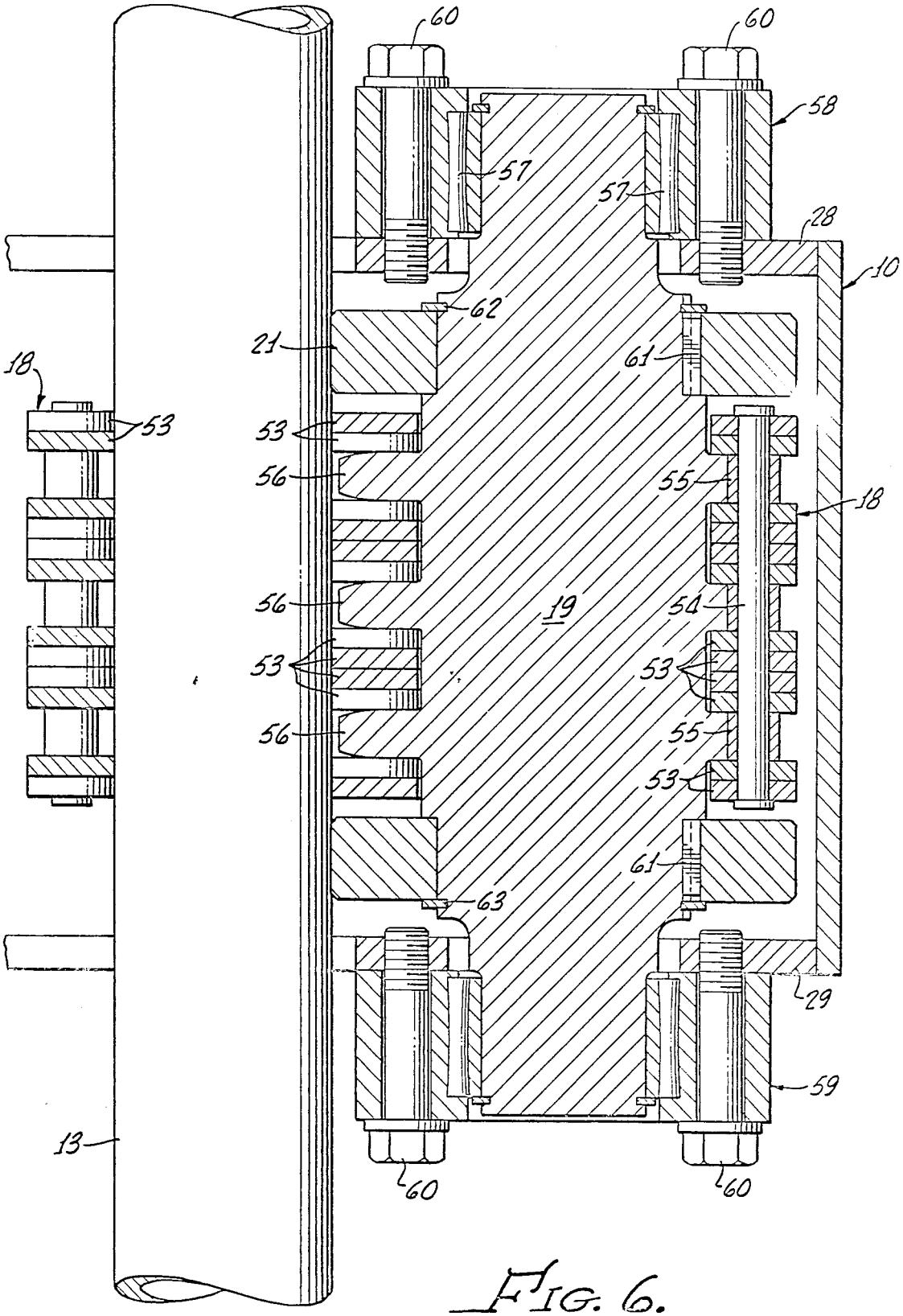
FIG. 6 is an enlarged fragmentary vertical sectional view on line 6—6 of FIG. 5.

The sprocket 17 may have various lengths, depending upon the amount of torque desired. The illustrated sprocket 17 has three tiers of gear teeth 52, which teeth are drivingly engaged (meshed) with the chain 18, such chain having such width as to be associated with all three tiers of teeth 52. As shown in FIGS. 4–6, chain 18 is a roller chain having intermeshed links 53 (FIG. 5) that are pivotally associated with each other by pins 54. There are rollers 55 provided about various portions of the pins and which fit between the gear teeth of the drive sprocket 17 and driven sprockets 19, 20. Rollers 55 are small in diameter and thus do not engage pipe 13.

As shown in FIG. 5, the chain 18 extends forwardly from drive sprocket 17 and around driven sprockets 19 and 20, the driven sprocket 19 being on the wide casing section 10 while the driven sprocket 20 is on the narrow casing section 11. The chain has an inverse internal portion that is generally between the driven sprockets, on the drive-sprocket side thereof, and such inverse internal portion receives and clamps the pipe 13.

Driven sprockets 19, 20 and associated parts are identical to each other, so only one will be described, with particular reference to FIG. 6. There is there shown the driven sprocket 19 and related parts on the wide casing section 10.

Driven sprocket 19 is a large-diameter, strong sprocket having three tiers of teeth 56 so as to mesh with and be driven by the chain 18. At its upper and lower ends, sprocket 19 extends through openings in upper and lower walls 28, 29 of wide casing section 10. Upper and lower spherical roller bearing assemblies 58 and 59, respectively, are mounted fixedly on walls 28, 29. Each bearing assembly includes a cup-shaped protective cap. Suitable snap rings hold the sprocket shaft against longitudinal shifting in the spherical roller bearings 58, 59.

Each of such bearing assemblies 58, 59 has an outer race through which are extended a plurality of bolts 60, the bolts being threaded into the housing walls. Elongated roller bearing elements 57 are rotatably associated with spherical-walled inner and outer races of the bearings 58, 59. The walls of elements 57 are concave so as to mate with the spherical walls of the races. Such bearings permit relatively free rotation of the driven sprockets 19, 20, while at the same time permitting a certain amount of adjustment of sprocket positions under load.

Referring again to FIG. 6, the above-indicated drive rollers, 21, 22 are keyed to the sprocket 19 by keys 61. Snap rings 62, 63 at the upper and lower end portions of the sprocket 19 cooperate with shoulders on the sprocket to hold the rollers 21, 22 against axial shifting.

The drive rollers 21, 22 at the ends of each casing section 10, 11 have outer diameters that are correlated to the widths of the links 53 of chain 18. The rollers have diameters that are only a few thousandths of an inch greater than the distances between the outer surfaces of chain links 53 at diametrically-opposite regions of the chain portion on the driven sprockets, when the chain 18 is wrapped tightly around the tubular element 13, as shown in FIG. 5. With such relationship, the rollers aid in preventing wear on the chain while, at the same time, cooperate effectively with the chain in providing very high-force gripping and driving actions relative to the outer surface of pipe 13.

There will next be given a description of casing section 11 and of the association of cylinders 14, 15 with the casing sections 10, 11. The relatively narrow casing section 11 has upper and lower walls 64 and 65, respectively, which are spaced slightly further apart than are the upper and lower walls 28, 29 of wide section 10. Thus, walls 64, 65 overlap and underlap the walls 28, 29 when the clamshell casing is closed. The sections 10 and 11 cooperate with each other to form a substantially continuous casing or housing around the chain, sprockets, etc.

It is to be understood that both of the casing sections 10 and 11 are made up of various welded pieces of steel, including not only the indicated upper and lower walls but also outer side walls, etc., there being no inner side walls on either casing section.

Welded to the upper and lower walls 64, 65 of narrow casing section 11, and extending upwardly and downwardly from such walls in coaxial relationship, are channel-shaped elements 66 and 67, respectively. Similarly, upper and lower coaxial channels 68, 69 are welded to the upper and lower walls 28, 29 of the wide casing section 10. The channels 66, 67 and 68, 69 are directly opposite each other, between the motor 16 and the pipe 13, and (as previously indicated) are relatively close to the pipe 13 so as to achieve a high mechanical advantage.

The channels face each other, and each channel has welded therein a bracket means 71 to which is pivotally connected a vertical sleeve at one end of the associated cylinder 14 or 15. Thus, one end of the cylinder portion of the cylinder 14 or 15 connects to a bracket on channel 68 or 69, while one end of the piston portion of cylinder 14 or 15 connects to a bracket on channel 66 or 67. In each instance, the pivotal relationship is such that pivotal movement about a vertical axis (when the pipe section 13 is vertical) is allowed.

The lower ends of channels 67 and 69 are extended down so as to be employed as legs when the tool is not in service. An additional leg, numbered 72, is connected to the bottom of wide housing section 10 at the back portion thereof. The channel 68 on wide casing section 11 also serves as the connection point for a curved bar 73 that suspends the entire tool when it is in service. At the upper, curved end of such bar is a connection means 74 (FIG. 2) for connecting the tool to a suspension cable, and for adjusting the balance point so that the tool hangs substantially vertically.

Each cylinder 14, 15 is connected to a source (not shown) of hydraulic fluid, which source (or another source) of hydraulic fluid is also suitably connected to the motor-gear assembly 16. The source is controllable to vary the pressure of the hydraulic fluid delivered to the cylinders 14, 15, and to the hydraulic motor, to thus control the amount of torque applied to pipe 13.

The source connected to motor-gear assembly 16 may include a pump for hydraulic fluid, to which is connected (through step-down gearing) to an air motor adapted to be driven at variable speed. During times when there is no substantial load on the motor, this pneumatic-hydraulic source operates the motor 16 fast so as to effect relatively rapid rotation of the pipe 13. On the other hand, when a great amount of torque is desired, as when a joint is first being broken or is being finally made up, the air motor moves very slowly to generate through the pump a high torque at lower speed. The pump is a relatively constant-horsepower pump.

As previously indicated, the cylinders 14 and 15 are disposed equal distances on opposite sides of the central horizontal plane of the tool, and are correspondingly connected to the casing sections 10 and 11. They thus apply very uniform, balanced forces to the clamshell casing and effectively close it with great force and with substantially no twisting or skewing.

There will next be described the preferred location of the pivot bolt 12 or fulcrum between the two clamshell-related casing sections 10, 11. In the preferred embodiment, the pivot bolt 12 extends through registered holes in overlapped portions of the upper and lower horizontal walls of casing sections 10, 11.

Referring to FIG. 3, the axis of the driven sprocket 19 on the wide casing section 10 is indicated at x. The axis of the drive sprocket 17 is indicated at y, while the axis of pivot bolt 12 is indicated at z. Let it be assumed that a line is drawn through points x and y and then extended to the left (FIG. 3). Point z, the pivot bolt axis, is disposed a substantial distance from such line, one the same side of such line as is the axis of driven sprocket 20 of the narrow casing section. This creates the advantage that the relatively narrow housing section 11 may be relatively light while still having adequate strength to grip the pipe 13 with great force when the cylinders 14, 15 close the clamshell.

Stated more specifically, let it be assumed that the indicated line extending through points x and y in FIG. 3, and then to the left of point y in such figure, is at a right angle to a line extending through point z (the pivot axis of the clamshell). The latter line, extending orthogonally to the extended x-y line, has a length between about one fourth the distance from point x to point y, to about one third the distance from point x to point y. In the present commercial embodiment, the distance between the extended x-y line and point z (in a direction perpendicular to the extended x-y line) is about three tenths the distance between x and y.

There will next be further described the means for adjusting the motor assembly 16 toward and away from pipe 13 in order to adapt the tool for spinning different diameters of pipe. The previously indicated holes 25 (FIG. 2), 26 and 27 (FIG. 3) are provided in the upper and lower walls 28, 29 of the wide casing section 10. The holes 25-27 on each side of such wide casing section are in a line extending generally parallel to a line between the drive sprocket 17 and the pipe 13. Each set of holes is adapted to receive one of two adjustment bolts 24. Such bolts 24 preferably have pointed lower ends (FIG. 4), and each extends downwardly through tail protuberances 35 of the upper and lower slide plates 31, 32. The lower portions of the bolts 24 are threaded into the lower wall 29 of housing section 10, or into the lower protuberances 35.

The locations of holes 25, 26 and 27 are precisely determined in accordance with the various standard pipe diameters to be operated upon by the tool, in accordance with the length of chain 1, and other factors. For example, such locating is performed so that, when the bolts 24 are in the rear holes 25 (the motor assembly 16 then being slid relatively far from the pipe), closing of the clamshell sections will effectively grip pipes 13 the outer diameters of which are in the range of $2\frac{3}{8}$ inches to 3 inches. When the motor 16 and associated slide plates 31, 32 are moved toward pipe 13 and the bolts 24 are inserted through protuberances 35 and the holes 26, it is known that closing of the clamshell sections will create proper gripping of pipe having a diameter in the range of $3\frac{1}{2}$ inches to 3 7/10 inches.

The locations of the holes 27 are such that, when the holes 24 are passed therethrough and through the protuberances 35, the motor 16, drive sprocket and other parts are properly adapted for clamping effectively on pipes having outer diameters in the range of $4\frac{1}{2}$ inches to $5\frac{1}{2}$ inches.

It is to be understood that suitable indicia, not shown, are provided on the upper wall 28 of wide casing section 10, adjacent the respective holes 25–27, such indicia indicating the pipe diameters to be operated upon when the bolts 24 extend through such holes.

The described adjustment system is extremely effective, inexpensive and foolproof. To change from one pipe diameter to another, which other diameter is in a different range, the operator merely removes the bolts 24 from one of the sets of holes 25–27, slides the motor 16, and then re-introduces the bolts 24. The shift from one pipe diameter to another in the same range, there is no need to even remove the bolts 24.

DESCRIPTION OF THE METHOD, AND OPERATION

The motor 16 is connected to the fluid source in such relationship to that motor, and to the control means (not shown) for motor 16, that when a joint is to be broken the pipe 13 will be driven counterclockwise as viewed from above.

The tool is then suspended at a wellhead. Alternatively, for example if the tool is being employed to rotate a horizontal pipe, the tool is suspended adjacent the horizontal element by a suitable suspension means, not shown.

The operator is aware of what diameter of pipe 13 is to be rotated, and adjusts the present tool accordingly. Other factors are the wall thickness of the pipe, and the torque requirements. The pressure of the hydraulic fluid to be delivered to cylinders 14, 15, and to the motor, is adjusted in accordance with the maximum torque required, such maximum torque being such that the pipe will not be crushed or excessively marred.

If the pipe diameter is in the lower range (for example, $2\frac{3}{8}$ inches to 3 inches), the adjustment bolts 24 are inserted through holes 25 (FIG. 2) after the motor 16 and associated slide plates have been slid far away from the pipe 13. Such an adjusted position is shown in FIGS. 3–5. If the pipe diameter is in the intermediate range (for example, $3\frac{1}{2}$ inches to 3 7/10 inches), the center holes 26 are employed, as described above. If the pipe is in the large-diameter range (for example, $4\frac{1}{2}$ inches to $5\frac{1}{2}$ inches), those holes 27 (FIG. 3) closest to the pipe 13 are utilized.

The various factors having thus been adjusted, it is merely necessary to operate the controls to introduce hydraulic fluid into the balanced cylinders 14, 15 to extend the same and force the housing sections 10, 11 to the open position shown in FIG. 1 and (in phantom lines) in FIG. 3. The tool is then swung in such manner that the pipe is in the inverse internal portion of the chain 18. Then, the controls are operated in such manner as to shorten the cylinders 14, 15 and thus very forcibly cause the clamshell-related sections 10, 11 to pivot about bolt 12 until the chain 18 is under great tension. The inverse internal portion of the chain is, at this time, wrapped tightly around the pipe 13, as shown at the right in FIG. 3, and also in FIG. 6. The drive rollers 21, 22 are, at this time, in high-pressure bearing relationship to the pipe 13, as shown in FIG. 6.

Because the pressure is great, and because the drive rollers 21, 22 engage the pipe surface in mutually tangential line-contact relationship, the rollers 21, 22 employed in the present tool are caused to be relatively wide (thick). For example, in the illustrated embodiment, the rollers 21 and $1\frac{1}{4}$ inches wide (thick). With such a width, there is a very strong driving relationship between the rollers and the pipe, yet the rollers do not cut the pipe.

The controls are then operated to drive the motor 16 and the drive sprocket 17 (FIGS. 4 and 5) in such a direction as to either make or break the joint between the tubular sections, as required by the particular operation. when a joint is being broken, the relationships are such that there is a self-energizing action between the chain and the pipe, such self-energizing action increasing the gripping contact between the chain and the pipe.

As shown in FIGS. 3, 5 and 6, the various links 53 of the chain have their edges in high-pressure bearing contact with the outer surface of pipe 13. Accordingly, and because the drive rollers 21, 22 also have their surfaces in driving contact with the pipe, rotation of the motor 16 and sprocket 17 to drive the chain, for conjoint driving of the chain and the drive rollers 21 so as to drive the pipe 13, effectively makes or breaks the joint in pipe 13, as required by the particular operation.

While the joint is relatively loose, so that there is little resistance presented to rotation of the pipe 13, the pipe is driven relatively rapidly, at a speed determined by the rate of fluid flow through the motor. For example, when hydraulic fluid flows through the motor at 20 gallons per minute, the rate of pipe turning is in the range of 27 to 62 revolutions per minute, depending upon pipe diameter. Much faster rates of rotation of the pipe may be achieved by causing more gallons per minute of fluid to pass through the motor 16.

As previously indicated, in the present specific example (which is given by way of example only, not limitation) the torque may range between about 762 foot pounds and about 4,030 foot pounds, depending upon pipe diameter and depending on whether the fluid pressure is 1,500 psi or up to 3,000 psi. It is to be understood that higher and lower pressures may be employed, with consequent lessening or increasing of the torque.

When there is great resistance to turning, for example when a previously-made joint is to be broken, or when a new joint is to be completed, the motor 16 is driven slowly but with great force so as to generate the indicated (and other) torques.

After the joint has been made or broken, as the case may be, the cylinders 14, 15 are operated so as to cause the clamshell-related casing sections 10 and 11 to pivot apart. Then, the tool is swung off the pipe 13, and the operation is repeated relative to another joint.

To adjust the tool for a different pipe diameter, which is in a different range, as explained above, the adjustment bolts 24 are unscrewed and pulled out, following which the motor 16 is slid to such position that the adjustment bolts may be reinserted through the appropriate one of holes 25-27 (FIG. 3). Thereafter, and after the appropriate fluid pressure has been determined and achieved, the different-diameter pipe sections are spun and torqued in one operation--with no necessity of changing tools or changing from one tool section to another tool section.

Preferably, but not necessarily, the pressure of hydraulic fluid delivered to the motor is the same as that of hydraulic fluid delivered to the clamping cylinders.

The foregoing detailed description is to be clearly understood as given by way of illustration and example only, the spirit and scope of this invention being limited solely by the appended claims.

What is claimed is:

1. Apparatus for rotating a tubular well element about the longitudinal axis thereof, said apparatus comprising:

(a) first and second elongate elements, (b) pivot means to pivotally connect said elements to each other, (c) first and second driven sprockets mounted, respectively, on said first and second elongate elements at locations remote from said pivot means, (d) a drive sprocket mounted on said first elongate element, (e) motor means mounted on said first elongate element to drive said drive sprocket, (f) a continuous chain mounted around said drive sprocket and said first and second driven sprockets, said chain having, when said first and second driven sprockets are pivoted toward each other, an inverse internal portion adapted to receive and directly contact the tubular well element to be rotated, and (g) cylinder means connected between said first and second elongate elements to pivot said first and second driven sprockets toward and away from each other and thus alternately clamp said inverse internal portion around said tubular well element, and release said tubular well element from said inverse internal portion, one end of said cylinder means being pivotally connected to said first elongate element at a point between said pivot means (b) and said first driven sprocket, the other end of said cylinder means being pivotally connected to said second elongate element at a point between said pivot means (b) and said second driven sprocket.

2. The invention as claimed in claim 1 in which driven rollers are mounted concentrically on said first and second driven sprockets, said drive rollers being driven by said first and second driven sprockets, said drive rollers directly contacting said tubular well element and cooperating with said chain in rotating said tubular element.

3. The invention as claimed in claim 1, in which said motor means (e) and said drive sprocket (d) are disposed generally between said pivot means (b) and said first and second driven sprockets.

4. A compact well pipe-rotating apparatus capable of generating high torque, said apparatus comprising:

(a) first and second clamshell elements, (b) pivot means to pivotally connect said first and second elements to each other in clamshell relationship, (c) pipe-engaging and rotating means, located on the portions of said elements remote from said pivot means (b), to directly engage a section of well pipe and to rotate said section about the longitudinal axis thereof, said pipe-engaging and rotating means being an elongated flexible continuous-loop element in direct engagement with said pipe section, (d) motor means to drive said pipe-engaging and rotating means (c), and (e) cylinder means, disposed between said pipe-engaging and rotating means (c) and said pivot means (b), to pivot said first and second elements about said pivot means (b), one end of said cylinder means (e) being pivotally connected to said first element at a point between said pipe-engaging and rotating means (c) and said pivot means (b), the other end of said cylinder means (e) being pivotally connected to said second element at a point between said pipeengaging and rotating means (c) and said pivot means (b).

5. The invention as claimed in claim 4, in which said pipe-engaging and rotating means (c) comprises, at the end of said first element remote from said pivot means (b), and at the end of said second element remote from said pivot means (b), a chain portion that directly engages and drives said well pipe section, and rollers that also directly engage and drive said well pipe section, said chain at each of said ends being meshed with a sprocket driven by said motor means, said rollers being mounted on and coaxial with said sprockets.

6. Apparatus for rotating a section of well pipe, said apparatus comprising:

(a) first and second elongate elements, (b) a drive sprocket mounted on said first elongate element, (c) motor means to drive said drive sprocket, (d) a first driven sprocket mounted on one end of said first elongate element, (e) a second driven sprocket mounted on one end of said second elongate element, (f) a continuous chain mounted around said drive sprocket and said first and second driven sprockets, said chain having an inverse internal portion adapted to receive, directly engage, and drive a section of well pipe, (g) pivot means to pivotally connect to each other the other ends of said first and second elongate elements, the axis of said pivot means (g) being on one side of a line that passes through the axis of said drive sprocket and the axis of said first driven sprocket, said axis of said pivot means (g) being spaced a substantial distance from said line, and being on the same side of said line as is the axis of said second driven sprocket, and (h) cylinder means to pivot said elongate elements about said pivot means, said cylinder means being disposed between said pivot means (g) and said first and second driven sprockets, and being connected to said elongate elements at points between said pivot means (g) and said first and second driven sprockets.

7. The invention as claimed in claim 6, in which said drive sprocket is mounted between said pivot means (g) and said first driven sprocket.

8. The invention as claimed in claim 7, in which the distance from the axis of said pivot means (g) to said line, in a direction perpendicular to said line, is in the range of from about $\frac{1}{4}$ to about $\frac{1}{3}$ of the distance from the axis of said drive sprocket to the axis of said first driven sprocket.

9. The invention as claimed in claim 8, in which said first-mentioned distance is about 0.3 times said second-mentioned distance.

10. The invention as claimed in claim 8, in which means are provided to adjust the position of the axis of said drive sprocket toward and away from said inverse internal portion.

11. Apparatus for rotating well pipes of different standard diameters, to make and break threaded joints therebetween, said apparatus comprising:

(a) casing means, (b) first and second driven sprockets, said driven sprockets and said casing means being so constructed and so associated with each other that said driven sprockets can move toward and away from each other for closing on a pipe and subsequent release of said pipe, (c) power means to cause said movement of said driven sprockets toward and away from each other, (d) motor means, (e) a drive sprocket connected to said motor means for driving thereby, said motor means and drive sprocket being conjointly movable toward and away from said driven sprockets, (f) a closed-loop chain mounted around said drive and driven sprockets, said chain having an inverse internal portion located generally between said driven sprockets and adapted to clamp directly on a well pipe section when said power means (c) is operated to move said driven sprockets (b) forcibly toward each other, and (g) a plurality of locating means provided on said casing means to locate said motor means and drive sprocket selectively in one of a plurality of predetermined positions, said positions being along the path of movement of said motor means and drive sprocket toward and away from said driven sprockets, each of said locating means having a predetermined position so selected that, when said motor means and drive sprocket are at the associated predetermined position, operation of said power means (c) to move said driven sprockets (b) towards each other will cause said inverse internal chain portion to clamp tightly around a pipe section having either of a plurality of standard outer diameters, whereby said apparatus can operate selectively on pipe sections having at least two different standard diameters, without moving said motor means and drive sprocket, and whereby said apparatus can operate selectively on pipe sections having at least four different standard diameters, by employing two of said locating means.

12. The invention as claimed in claim 11, in which said locating means are precisely-positioned holes in said casing means, and in which elongate elements are provided to extend selectively through said holes and through holes fixedly related to said motor means.

13. A method of rotating sections of tubular well elements having different diameters, said method comprising:

(a) providing casing means having motor means and drive sprocket movably mounted thereon for adjustment along a predetermined path,
 said casing means having two driven sprockets movably associated therewith, said driven sprockets being so positioned that when said motor means and drive sprocket are at different positions along said predetermined path, they are either closer to or farther from said driven sprockets, (b) providing a chain in meshed relationship around said drive sprocket and driven sprockets,
 said chain having an inverse internal portion generally between said driven sprockets, and adapted to receive and directly engage a tubular well element to be rotated, (c) providing cylinder means to move said driven sprockets forcibly toward each other to clamp said inverse internal portion tightly around a tubular well element in direct engagement therewith, and then to move said driven sprockets away from each other to release said tubular element from said inverse internal portion, (d) selectively maintaining said motor means and drive sprocket at, and only at, a plurality of discrete positions along said path, and (e) selecting each of said discrete positions so that, when said motor means and drive sprocket are maintained thereat, operation of said cylinder means (c) to clamp said inverse internal portion tightly around a tubular element creates the correct relationship between said inverse internal portion and at least two standard diameters of tubular elements.

14. A method of spinning and torquing tubular elements in one operation, in order to make up, torque, and break out tubular connections, said method comprising:

(a) providing first and second elongate elements that are pivotally associated with each other, in clamshell relationship, by pivot means, (b) providing driven sprockets at corresponding ends of said elongate elements for movement toward and away from each other as said clamshell-related elongate elements close and open, (c) providing motor means and a drive sprocket,
 said drive sprocket being driven by said motor means, (d) providing a chain in meshed relationship around said drive sprockets and driven sprockets, and having an inverse internal tubular well elementreceiving portion generally between said driven sprockets, (e) connecting hydraulic cylinder means between said elongate elements at points between said pivot means and said driven sprockets, (f) employing said hydraulic cylinder means to close said clamshell-related elongate elements with great force, thus causing said inverse internal portion to clamp tightly around a tubular well element in direct engagement therewith, (g) operating said motor means (c) to drive said chain to spin said tubular well element about its longitudinal axis in such direction as to make a threaded connection between said tubular element and another tubular element, and (h) continuing said step (g) until said tubular connection is fully made up and torqued, and without employing any other tool or tool portion to complete the connection.

15. The invention as claimed in claim 14, in which said method also comprises operating said motor means (c) to initially break a joint and then to spin the tubular element to complete breaking of the joint.

16. The invention as claimed in claim 14, in which said method further comprises providing hydraulic motor means as said motor means (c), and supplying high-pressure hydraulic fluid to said motor means.

17. The invention as claimed in claim 14, in which said method further comprises providing upper and lower drive rollers on each of said driven sprockets coaxially therewith, the outer diameters of said drive sprockets being sized to grip and drive said tubular element conjointly with gripping and driving thereof by said chain, and causing said rollers to be sufficiently thick not to cut said tubular element despite the high clamping pressure employed.

18. Apparatus for spinning and torquing sections of wall pipe, said apparatus comprising:

(a) a relatively wide casing section, (b) a relatively narrow casing section, (c) pivot means to pivotally connect said casing sections to each other in clamshell relationship, (d) a drive motor mounted on said wide casing section, (e) a drive sprocket rotatably mounted within said wide casing section and driven by said drive motor, (f) a first driven sprocket rotatably mounted in said wide casing section at one end thereof remote from said pivot means (c), (g) a second driven sprocket rotatably mounted in said narrow casing section at an end thereof remote from said pivot means (c), (h) a closed-loop chain mounted in meshed relationship around said drive and driven sprockets,
 said chain having an inverse internal portion between said first driven sprocket and said second driven sprocket, and which is adapted to receive and directly engage a section of pipe, and (i) cylinder means connected between said wide and narrow casing sections at points thereof between said driven sprockets and said pivot means,
 said cylinder means being operative to open and close said clamshell-related casing sections with high force and mechanical advantage.

19. The invention as claimed in claim 18, in which each of said driven sprockets (f) and (g) has a roller at the upper and lower portions thereof, said rollers being concentric with said driven sprockets on which they are mounted, said rollers being nonrotatably associated with the sprockets on which they are mounted, the outer diameters of said rollers being such that the outer surfaces of said rollers directly engage the well pipe section within said inverse internal portion simultaneously with engagement of said pipe section by said inverse internal portion upon operation of said cylinder means (i) to close said clamshell-related casing.

20. The invention as claimed in claim 19, in which said rollers are drive rollers nonrotatably associated with said driven sprockets, and in which said chain (h) is a roller chain.

21. The invention as claimed in claim 18, in which said cylinder means (i) comprises upper and lower cylinders corresponding to each other in size and location, said upper cylinder being above said casing sections (a) and (b), said lower cylinder being below said casing sections (a) and (b), each of said cylinders being pivotally connected between said wide and narrow casing sections at points thereof that are relatively close to said inverse internal portion of said chain.

22. The invention as claimed in claim 21, in which each of said cylinders is hydraulic,

23. The invention as claimed in claim 18, in which said drive motor (d) comprises a hydraulic motor and gear assembly adjustably mounted on said wide casing section for adjustment toward and away from said inverse internal portion of said chain, and in which said drive sprocket (e) is mounted on the output shaft of said motor and gear assembly.

24. The invention as claimed in claim 18, in which the axis of said drive sprocket (e) is disposed generally between said first driven sprocket (f) and said pivot means (c).

25. The invention as claimed in claim 18, in which said pivot means (c) is a single pivot element pivotally connecting said sections (a) and (b) to each other, and in which the distance from the axis of said pivot means (c) to an extended line containing the axes of said first driven sprocket (f) and said drive sprocket (e), in a direction perpendicular to said line, is in the range of about $\frac{1}{4}$ to $\frac{1}{3}$ of the distance between the axis of said first driven sprocket (f) and the axis of said drive sprocket (e).

26. The invention as claimed in claim 18, in which slide means are provided to effect sliding of said drive motor (d) and drive sprocket (e) toward and away from said inverse internal portion to adjust the apparatus for spinning pie sections having different diameters, in which a plurality of holes are provided in said wide casing section (a) along the path of sliding of said drive motor and drive sprocket toward and away from said inverse internal portion, in which mounting means for said drive motor (d) is provided with holes adapted to register with said first-mentioned holes, in which elongated means are provided for insertion through said holes associated with said drive motor and said holes in said wide casing section, the particular holes in said wide casing section through which said elongated means are projected being determined by the position of said motor and drive sprocket, and in which said first-mentioned holes are so selected and positioned that, when said elongated elements are extending through any one of the sets of holes in said wide casing section, operation of said cylinder means (i) to close said casing sections will cause said inverse internal portion to clamp effectively on a pipe section having a first standard outer diameter, and alternatively on a pipe section having a second standard outer diameter.

27. The invention as claimed in claim 18, in which said wide casing section (a) has parallel upper and lower walls, said walls having relatively large openings therein, in which upper and lower slide plates are mounted in sliding relationship to said casing section walls at the upper surface of said upper wall and the lower surface of said lower wall, in which bolts and spacers are connected through said openings in said walls to maintain said slide plates in sliding relationship to said casing walls without clamping against said casing walls, and in which means are provided to hold said slide plates in different adjusted positions.

* * * * *

UNITED STATES PATENT AND TRADEMARK OFFICE

CERTIFICATE OF CORRECTION

PATENT NO. : 4,843,924

DATED : July 4, 1989

INVENTOR(S) : Thomas D. Hauk

It is certified that error appears in the above-identified patent and that said Letters Patent is hereby corrected as shown below:

Claim 2 (column 10, line 56), delete "driven" and substitute therefor ---drive---.

Claim 4 (column 11, line 24), delete "pipeengaging" and substitute therefor ---pipe-engaging---.

Claim 13 (column 13, line 10), before the word "drive", add ---a---.

Claim 14 (column 13, lines 58 and 59), delete "elementreceiving" and substitute therefor ---element-receiving---.

Claim 18 (column 14, line 48), after "of" and before "pipe", add ---well---.

Claim 26 (column 16, line 3), delete "pie" and substitute therefor ---pipe---.

Signed and Sealed this

Seventeenth Day of April, 1990

*Attest:*

HARRY F. MANBECK, JR.

*Attesting Officer*

*Commissioner of Patents and Trademarks*